US007572968B2

(12) United States Patent
Komano

(10) Patent No.: US 7,572,968 B2
(45) Date of Patent: Aug. 11, 2009

(54) ELECTRONIC MUSICAL INSTRUMENT

(75) Inventor: Takeshi Komano, Iwata (JP)

(73) Assignee: Yamaha Corporation, Hamamatsu-Shi (JP)

( * ) Notice: Subject to any disclaimer, the term of this patent is extended or adjusted under 35 U.S.C. 154(b) by 219 days.

(21) Appl. No.: 11/373,572

(22) Filed: Mar. 10, 2006

(65) Prior Publication Data

US 2006/0219090 A1 Oct. 5, 2006

(30) Foreign Application Priority Data

Mar. 31, 2005 (JP) ..... 2005-103404

(51) Int. Cl.
*G10H 7/00* (2006.01)

(52) U.S. Cl. ..... 84/609; 84/615; 84/622

(58) Field of Classification Search ..... 84/600–609, 84/645, 615, 622

See application file for complete search history.

(56) References Cited

U.S. PATENT DOCUMENTS

| | | | | |
|---|---|---|---|---|
| 5,138,925 | A * | 8/1992 | Koguchi et al. | 84/609 |
| 5,155,286 | A | 10/1992 | Saito et al. | |
| 5,248,843 | A | 9/1993 | Billings | |
| 5,668,334 | A * | 9/1997 | Kuribayashi et al. | 84/602 |
| 5,792,971 | A * | 8/1998 | Timis et al. | 84/609 |
| 5,915,237 | A * | 6/1999 | Boss et al. | 704/270.1 |
| 6,143,973 | A * | 11/2000 | Kikuchi | 84/645 |
| 6,281,424 | B1 * | 8/2001 | Koike et al. | 84/636 |
| 7,030,309 | B2 | 4/2006 | Kubita | |
| 2004/0055442 | A1 | 3/2004 | Terada | |

FOREIGN PATENT DOCUMENTS

| | | |
|---|---|---|
| EP | 0 322 871 | 7/1989 |
| EP | 1 172 796 | 1/2002 |
| JP | 7-253780 | 10/1995 |
| JP | 11-282465 | 10/1999 |
| JP | 2000-224269 | 8/2000 |
| JP | 2003-208174 | 7/2003 |
| JP | 2004-219947 | 8/2004 |

OTHER PUBLICATIONS

Sonar 4 User's Manual (Twelve Tone Systems. 2004). pp. 127, 165, 175, and 198).* www.pgmusic.com for teachings of modifying the registration parameters of a song within a song (e.g., style, tone color, tempo, etc.).*

Image-Line Software "Getting Started", FL Studio 4 Creative Edition, 2003, XP-002392365.

* cited by examiner

*Primary Examiner*—David S. Warren
(74) *Attorney, Agent, or Firm*—Morrison & Foerster LLP

(57) ABSTRACT

The present invention enables a user to select and control on an electronic musical instrument, just by selecting a registration data set, the mode for generating musical tones, automatic performance tones, and voice signals at once. More specifically, in a ROM 23 and external storage device 25 there are stored a plurality of registration data sets. Each registration data set includes a plurality of control parameters for controlling mode in which musical tones are generated such as tone color and loudness, MIDI song specifying data for specifying MIDI song data (automatic performance data), and audio song specifying data for specifying audio song data (voice data). By selecting a registration data set by an operation of setting operators 12, the mode for generating musical tones is controlled in accordance with the control parameters with MIDI song data and audio song data being simultaneously reproduced in accordance with the selected registration data set.

8 Claims, 12 Drawing Sheets

FIG.3

| |
|---|
| MIDI song file D |
| MIDI song file E |
| MIDI song file F |
| ⋮ |
| audio song file d |
| audio song file e |
| audio song file f |
| ⋮ |
| registration bank B4 |
| registration bank B5 |
| ⋮ |
| registration bank B10 |

FIG.4

| |
|---|
| tone color |
| loudness |
| tempo |
| style |
| transposition |
| ⋮ |
| MIDI song specifying |
| audio song specifying |
| ⋮ |
| MIDI song data |
| audio song data |
| other control parameters, etc. |
| ⋮ |

ELECTRONIC MUSICAL INSTRUMENT

BACKGROUND OF THE INVENTION

1. Field of the Invention

The present invention relates to an electronic musical instrument in which the mode for generating musical tones is controlled through the use of registration data composed of a plurality of control parameters for controlling the mode for generating musical tones, the mode being specified by a plurality of setting operators provided on an operating panel.

2. Description of the Related Art

As shown in Japanese Patent Laid-Open Publication No. 07-253780, there has been a well-known registration function. In the registration function, musical tone control parameters such as tone color data representative of a tone color of a musical tone to be generated, loudness data representative of the loudness of a musical tone to be generated, style data for specifying the type of accompaniment tones, effect data representative of an effect to be added to a musical tone to be generated are previously stored in a memory as a set of registration data. Alternatively, the registration data set is specified by a user through the use of a plurality of setting operators provided on an operating panel and is written into the memory. In this conventional scheme, each registration data set is assigned to a button to make it possible to read out a registration data set with single button operation even during performance of a song, enabling the user to establish the mode for generating musical tones on an electronic musical instrument in a short time. Recently, in addition, another type of electronic musical instrument came on the market. In this electronic musical instrument, a set of registration data also contains automatic performance specifying data for specifying a set of automatic performance data (MIDI song data) so that the user's selection of a registration data set followed by the user's operation of a reproduction start switch causes generation of automatic performance tones on the basis of the automatic performance data set specified by the automatic performance specifying data.

In the above-described conventional apparatuses, however, voice data (audio song data) representative of voice signal cannot be automatically specified on the basis of registration data. Therefore, the conventional electronic musical instruments are unable to play a melody part while generating accompaniment tones on the basis of previously recorded voice data or to add an audio song or audio phrase as background music (BGM) or effect tones during a performance by a user or during reproduction of automatic performance tones on the basis of automatic performance data.

SUMMARY OF THE INVENTION

The present invention was accomplished to solve the above-described problem, and an object thereof is to provide an electronic musical instrument in which not only musical tone control parameters and automatic performance data but also voice data are automatically specified by registration data in order to enable a user to select and control at once, just by selecting a registration data set, the mode for generating musical tones, the automatic performance tones, and the voice signals.

In order to achieve the above-described object, it is a feature of the present invention to provide an electronic musical instrument comprising a registration data storage portion for storing a plurality of registration data sets each composed of a plurality of control parameters for controlling mode in which a musical tone is generated, the mode being defined by a plurality of setting operators provided on an operating panel, an automatic performance data storage portion for storing a plurality of automatic performance data strings each composed of a performance data string for controlling generation of a string of musical tone signals that form a song, and a voice data storage portion for storing a plurality of voice data strings each composed of a data string representative of a voice signal wherein each of the registration data sets includes automatic performance specifying data for specifying any one of the automatic performance data strings and voice specifying data for specifying any one of the voice data strings.

In this case, voice data (i.e., audio song data) indicates audio data in which, for example, human singing voices, voices of musical instruments, and effect tones (natural tones and synthesized tones) are digitally converted or digitally compressed. As for the audio data, audio signals can be reproduced merely by use of a digital-to-analog converter. Furthermore, the electronic musical instrument may include a registration control portion for loading into a temporary storage portion, when one of the registration data sets is selected, not only control parameters contained in the selected registration data set but also an automatic performance data string and a voice data string specified respectively by automatic performance specifying data and voice specifying data contained in the selected registration data set, wherein the electronic musical instrument controls mode in which a musical tone is generated, emits an automatic performance tone and generates a voice signal on the basis of the control parameters, the automatic performance data string and the voice data string loaded into the temporary storage portion.

In the feature of the present invention configured as above, each registration data set contains a plurality of control parameters, automatic performance specifying data and voice specifying data, enabling a user to specify the mode in which musical tones are generated, automatic performance data and voice data at once only by selecting a registration data set. As a result, the feature of the present invention enables the user to play a melody part while generating accompaniment tones on the basis of previously recorded voice data or to add an audio song or audio phrase as background music (BGM) or effect tones during a performance by the user or during reproduction of automatic performance tones on the basis of automatic performance data, providing the user with enriched music.

It is another feature of the present invention to provide an electronic musical instrument comprising the registration data storage portion, the automatic performance data storage portion, and the voice data storage portion, wherein each of the registration data sets includes one of two type of specifying data: automatic performance specifying data for specifying any one of automatic performance data strings and voice specifying data for specifying any one of voice data strings, and the other of the two types of specifying data: the automatic performance specifying data and the voice specifying data is included in automatic performance data string or voice data string specified by the one of the two types of specifying data.

In this case as well, voice data indicates audio data in which, for example, human singing voices, voices of musical instruments, and effect tones are digitally converted or digitally compressed. Furthermore, the electronic musical instrument may include a registration control portion for loading into a temporary storage portion, when one of the registration data sets is selected, not only control parameters contained in the selected registration data set but also an automatic performance data string or a voice data string specified by the one of the two types of specifying data contained in the selected registration data set as well as loading, into the temporary storage portion, an automatic performance data string or a voice data string specified by the other specifying data included in the automatic performance data string or voice data string, wherein the electronic musical instrument controls mode in which a musical tone is generated, emits an automatic performance tone and generates a voice signal on the basis of the control parameters, the automatic performance data string and the voice data string loaded into the temporary storage portion.

In this feature of the present invention configured as above, each registration data set contains not only a plurality of control parameters but also one of two types of specifying data: the automatic performance specifying data and the voice specifying data, while the other of the two types of specifying data is included in automatic performance data or voice data specified by the one of the specifying data. Only by selecting a registration data set, therefore, the user can specify the mode in which musical tones are generated, automatic performance data and voice data at once. As a result, this feature of the present invention also enables the user to play a melody part while generating accompaniment tones on the basis of voice data or to add an audio song or audio phrase as background music (BGM) or effect tones during a performance by the user or during reproduction of automatic performance tones on the basis of automatic performance data, providing the user with enriched music. In addition, since a registration data set contains only one of the two types of specifying data with the other specifying data being contained in automatic performance data or voice data specified by the one of the specifying data, this feature of the present invention enables the user to establish the other specifying data at the disposal of the user to realize effective reproduction of the both data and facilitated synchronous reproduction.

It is still another feature of the invention to provide an electronic musical instrument wherein the one of the two types of specifying data is automatic performance specifying data while the other specifying data is voice specifying data, the automatic performance data storage portion stores the performance data string along with timing data representative of a timing at which a musical tone signal is generated in a song, and the voice specifying data is embedded in the performance data string along with the timing data. This feature of the invention realizes automatic reproduction of background music (BGM) and effect tones such as audio song and audio phrase at user's desired timing during an automatic performance on the basis of automatic performance data.

It is a further feature of the invention to provide an electronic musical instrument wherein the registration control portion loads into the temporary storage portion, at the time of selecting a registration data set from among the registration data sets, only the top part of voice data string specified by the voice specifying data. In this case, the remaining voice data may be then loaded into the temporary storage portion at every given timing, at every time a given amount of voice data written into the temporary storage portion has been reproduced with remaining voice data in the temporary storage portion that has not been reproduced falling below a given amount, at idle times during other program processing, or the like. Even in a case where the amount of voice data is so massive as to require much time to load the data into the temporary storage portion, this feature avoids insufficient storage area for the voice data in the temporary storage portion as well as prolonged time required until reproduction of the voice data.

Furthermore, the present invention can be embodied not only as an invention of an apparatus but also as an invention of a computer program and a method applied to the apparatus.

BRIEF DESCRIPTION OF THE DRAWINGS

FIG. 3 is a memory map showing data stored in a hard disk of the electronic musical instrument;

FIG. 4 is a memory map showing data stored in a RAM of the electronic musical instrument;

DESCRIPTION OF THE PREFERRED EMBODIMENT

Figure 1:
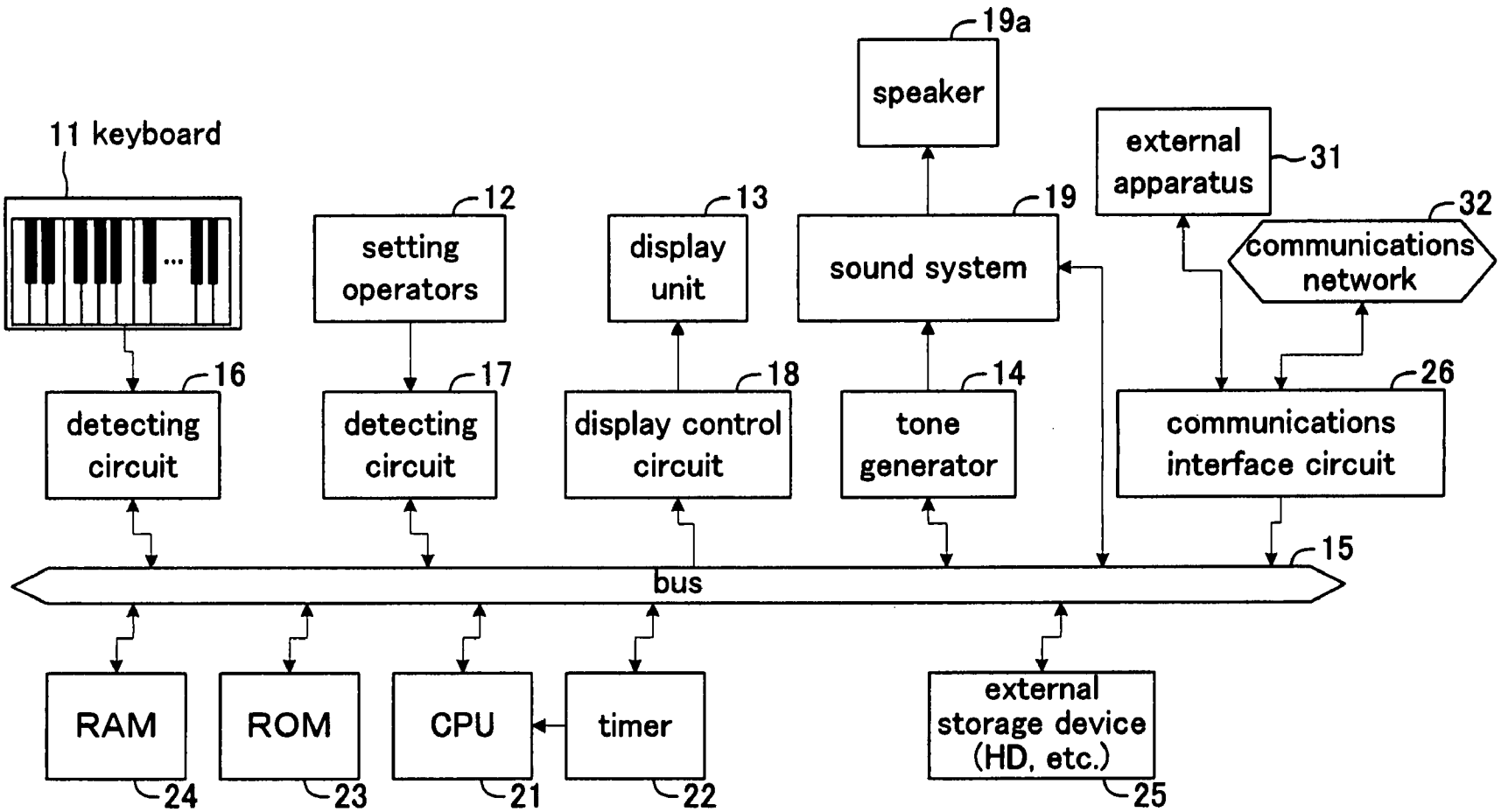
FIG. 1 is a block diagram showing the general arrangement of an electronic musical instrument according to an embodiment of the present invention.

An embodiment of the present invention will now be described with reference to the drawings. FIG. 1 is a block diagram schematically showing an electronic musical instrument according to the present invention. The electronic musical instrument is provided with a keyboard 11, setting operators 12, a display unit 13 and a tone generator 14.

The keyboard 11 is composed of a plurality of keys used as performance operators for specifying the pitch of a musical tone to be generated. The operation of the respective keys is detected by a detecting circuit 16 connected to a bus 15. The detecting circuit 16 also includes a key touch sensing circuit for sensing the velocity of a key depression of the respective keys, and outputs a velocity signal representative of the velocity of a key depression at each key depression. The setting operators 12 are provided on an operating panel of the electronic musical instrument and are composed of a plurality of setting operators for providing instructions regarding behaviors of respective parts of the electronic musical instrument, particularly, instructions regarding mode for generating musical tones and registration data. The operation of the respective setting operators is detected by a detecting circuit 17 connected to the bus 15. The display unit 13 is configured by a liquid crystal display, a CRT or the like provided on the operating panel, displaying characters, numerals, graphics, etc. What is displayed on the display unit 13 is controlled by a display control circuit 18 that is connected to the bus 15.

The tone generator 14, which is connected to the bus 15, generates digital musical tone signals on the basis of performance data and various musical tone control parameters supplied under the control of a later-described CPU 21, and outputs the signals to a sound system 19. The tone generator 14 also includes an effect circuit for adding various musical effects such as chorus and reverb to the above-generated digital musical tone signals. The sound system 19, which includes digital-to-analog converters, amplifiers and the like, converts the above-supplied digital musical tone signals to analog musical tone signals and supplies the analog musical tone signals to speakers 19*a*. To the sound system 19 there are also supplied digital voice signals from the CPU 21 through the bus 15. The sound system 19 also converts the supplied digital voice signals to analog voice signals and supplies to the speakers 19*a*. The speakers 19*a* emit musical tones and voices corresponding to the supplied analog musical tone signals and analog voice signals.

The electronic musical instrument also includes a CPU 21, timer 22, ROM 23 and RAM (a temporary storage portion) 24 that are connected to the bus 15 and compose the main body of a microcomputer. The electronic musical instrument also has an external storage device 25 and a communications interface circuit 26. The external storage device 25 includes various storage media such as hard disk HD and flash memory that are previously incorporated in the electronic musical instrument, and compact disk CD and flexible disk FD that are attachable to the electronic musical instrument. The external storage device 25 also includes drive units for the storage media to enable storing and reading of data and programs that will be described later. Those data and programs may be previously stored in the external storage device 25. Alternatively, those data and programs may be externally loaded through the communications interface circuit 26. In the ROM 23 as well there are previously stored various data and programs. At the time of controlling the operation of the electronic musical instrument, furthermore, various data and programs are transferred to be stored from the ROM 23 or the external storage device 25 to the RAM 24.

The communications interface circuit 26 is capable of connecting to an external apparatus 31 such as another electronic musical instrument or a personal computer to enable the electronic musical instrument to exchange various programs and data with the external apparatus 31. The external connection through the communications interface circuit 26 can be done via a communications network 32 such as the Internet, enabling the electronic musical instrument to receive and transmit various programs and data from/to outside.

Figure 2:
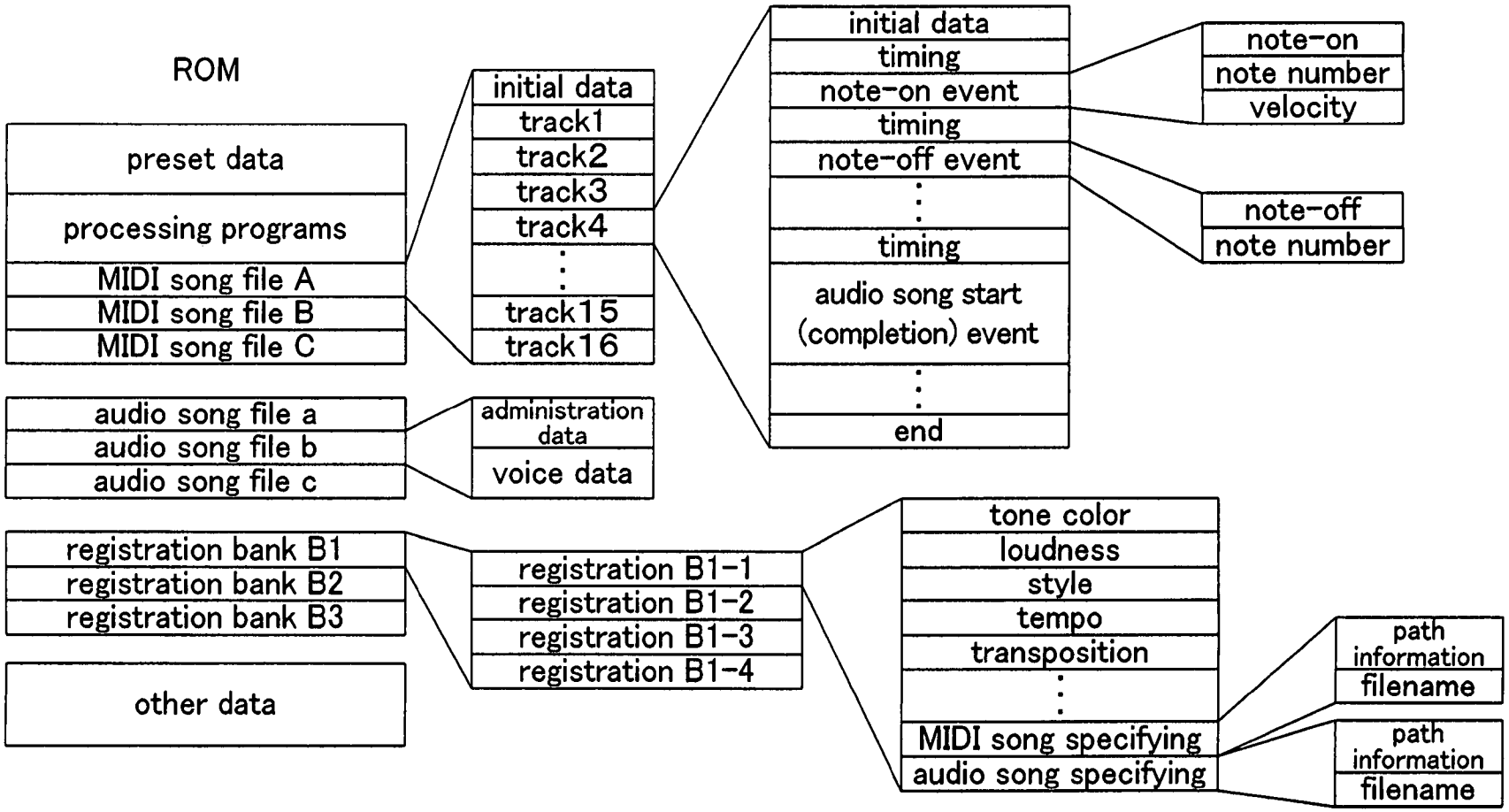
FIG. 2 is a memory map showing data stored in a ROM of the electronic musical instrument.

Next explained will be data and programs that are previously stored in the ROM 23 and the external storage device 25 or transferred and stored in the RAM 24. Previously stored in the ROM 23 are, as shown in FIG. 2, a plurality of preset data units, a plurality of processing programs, a plurality of MIDI song files, a plurality of audio song files, a plurality of registration banks each having a plurality of registration data sets, and other data. The preset data units are the data necessary for operations of the electronic musical instrument such as mode for generating musical tones. The processing programs are the fundamental programs for making the CPU 21 active.

The MIDI song files are the file for storing an automatic performance data string composed of a performance data string for controlling generation of a string of musical tone signals that form a song. For the present embodiment there are provided three demonstration files of files A, B and C. Each MIDI song file is composed of an initial data unit and a plurality of track data units (e.g., 16 track data units). The initial data unit is composed of control parameters about general matters of a song that are defined at the start of an automatic performance such as performance tempo, style (type of accompaniment), loudness of musical tones, loudness balance between musical tones, transposition, musical effects.

Each of the track data units corresponds to a part such as melody, accompaniment and rhythm, being composed of initial data, timing data, various event data, and end data. Initial data of a track data unit is composed of control parameters about matters on the track (part) that are defined at the start of an automatic performance such as tone color of musical tones, loudness of musical tones, and effect added to musical tones. Each timing data unit corresponds to an event data unit, representing the control timing for the event data unit. The timing data is absolute timing data representative of the absolute time (i.e., bar, beat, and timing in a beat) measured from the start of an automatic performance.

Event data includes at least note-on event data, note-off event data, and audio song start (or completion) event data. Note-on event data represents the start of generation of a musical tone signal (corresponds to performance data on the keyboard 11), being composed of note-on data, note number data and velocity data. Note-on data represents the start of generation of a musical tone signal (key-depression on the keyboard 11). Note number data represents the pitch of a musical tone signal (key on the keyboard 11). Velocity data represents the loudness level of a musical tone signal (velocity of a key-depression on the keyboard 11). Note-off event data is composed of note-off data and note number data. Note-off data represents the completion of generation of a musical tone signal (key-release on the keyboard 11). Note number data is the same as the one described in the case of the note-on event data. Audio song start event data represents the start of reproduction of audio song data. Audio song completion event data represents the completion of reproduction of audio song data. End data represents the completion of an automatic performance of a track. Event data may include control parameters for controlling mode for generating musical tones (tone color, loudness, effect and the like) to change the mode in which musical tones are generated during an automatic performance.

The respective audio song files correspond to respective voice data strings each composed of a data string representative of voice signals. For the present embodiment there are provided three files of a, b and c. Each of the audio song files is composed of administration data and voice data. Administration data is data on decoding required for reproducing voice data. Voice data is digital audio data in which human voices, voices of musical instruments and effect tones are digitally converted or digitally compressed.

Each of the registration data sets is composed of a plurality of control parameters for controlling the mode in which musical tone signals are generated, the mode being specified through the use of the setting operators 12 on the operating panel. In the present embodiment, 12 sets of registration data B1-1, B1-2 . . . are provided for use in demonstration, being classified under three registration banks B1, B2 and B3. Each registration data set includes a plurality of control parameters for controlling tone color of musical tones, loudness of musical tones, style (type of accompaniment), performance tempo, transposition, loudness balance between musical tones, musical effect, and the like. Each registration data set also contains MIDI song specifying data and audio song specifying data. MIDI song specifying data is the data for specifying a MIDI song file (automatic performance data), being composed of path information indicative of the location where the MIDI song file is stored and data representative of its filename. Audio song specifying data is the data for specifying an audio song file (voice data), being composed of path information indicative of the location where the audio song file is stored and data representative of its filename.

Stored in the external storage device 25 are, as shown in FIG. 3, a plurality of MIDI song files D, E, F . . . , a plurality of audio song files d, e, f . . . , a plurality of registration banks each having a plurality of registration data sets. The MIDI song files D, E, F . . . and the audio song files d, e, f . . . are configured similarly to the MIDI song files A, B and C and the audio song files a, b and c stored in the ROM 23, respectively. The present embodiment is provided with seven registration banks of B4 through B10, each capable of having four registration data sets. The respective registration data sets are configured similarly to those stored in the ROM 23. The MIDI song files, audio song files and registration data stored in the external storage device 25 may be created by a user through program processing that will be described later. Alternatively, those files and data stored in the external storage device 25 may be loaded via the communications interface 26 from the external apparatus 31 or an external apparatus connected with the communications network 32.

In the RAM 24, as shown in FIG. 4, there are the area for writing a set of registration data (see FIG. 2) and the area for storing MIDI song data (automatic performance data) and audio song data (voice data) respectively specified by MIDI song specifying data and audio song specifying data contained in the registration data set. In the RAM 24 there are also stored other control parameters for controlling the operation of the electronic musical instrument.

The operation of the electronic musical instrument configured as described above will now be described with reference to flowcharts shown in FIG. 5 through FIG. 13. When a user turns on a power switch (not shown) of the electronic musical instrument, the CPU 21 starts executing a main program at step S10 shown in FIG. 5. At step S11 the CPU 21 executes processing for establishing initial settings for activating the electronic musical instrument. After the initial setting, the CPU 21 repeatedly executes circulating processing consisting of steps S12 to S15 until the power switch is turned off. When the power switch is turned off, the CPU 21 terminates the main program at step S16.

While the circulating processing is in process, by panel operation processing of step S12 the CPU 21 controls and changes, in response to the user's operation on the setting operators 12, the mode in which the electronic musical instrument operates, particularly, the mode in which musical tones are generated (tone color, loudness, effect and the like). Operations defined by registration data that directly relates to the present invention will be detailed later with reference to flowcharts showing routines shown in FIG. 6 to FIG. 11.

At keyboard performance processing of step S13, the CPU 21 controls generation of musical tones in accordance with user's performance on the keyboard 11. More specifically, when a key on the keyboard 11 is depressed, performance data composed of note-on data representative of a key-depression, note number data representative of the depressed key, and velocity data representative of the velocity of the key-depression is supplied to the tone generator 14. In response to the supplied performance data, the tone generator 14 starts generating a digital musical tone signal having the pitch and loudness that correspond to the supplied note number data and velocity data, respectively. The tone generator 14 then emits a musical tone corresponding to the digital musical tone signal through the sound system 19 and the speakers 19*a*. In this case, the tone color, loudness and the like of the digital musical tone signal generated by the tone generator 14 are defined under the control on the mode for generating musical tones that includes registration data processing. When the depressed key is released, the CPU 21 controls the tone generator 14 to terminate the generation of the digital musical tone signal. The emission of the musical tone corresponding to the released key is thus terminated. Due to the above-described keyboard performance processing, a musical performance on the keyboard 11 is played.

At song data reproduction processing of step S14, the CPU 21 controls generation of automatic performance tones on the basis of MIDI song data (automatic performance data) as well as generation of audio signals on the basis of audio song data (voice data). These controls will be detailed later with reference to flowcharts shown in FIG. 12 and FIG. 13.

Next explained will be processing on registration data. When the user operates the setting operators 12 to provide instructions for selecting a registration bank, the CPU 21 starts a bank setting processing routine at the panel operation processing of step S12 of FIG. 5. The bank setting processing routine shown in FIG. 6 is started at step S20. At step S21, a screen for selecting a registration bank (see FIG. 15) is displayed on the display unit 13. The selection of a registration bank is done by operating a bank selecting operator 12*a* shown in FIG. 14 which enlarges part of the setting operators 12. On the screen for selecting a registration bank, if the user operates the setting operators 12 such as one click of a mouse on a desired registration bank displayed on the registration bank selecting screen, the desired registration bank is selected. Shown in FIG. 15 is a state in which a registration bank B7 has been selected. After the selection of a registration bank, if the user operates the setting operators 12 to change the name of the registration bank, the name of the selected registration bank is changed by the process of step S23.

Figure 7:
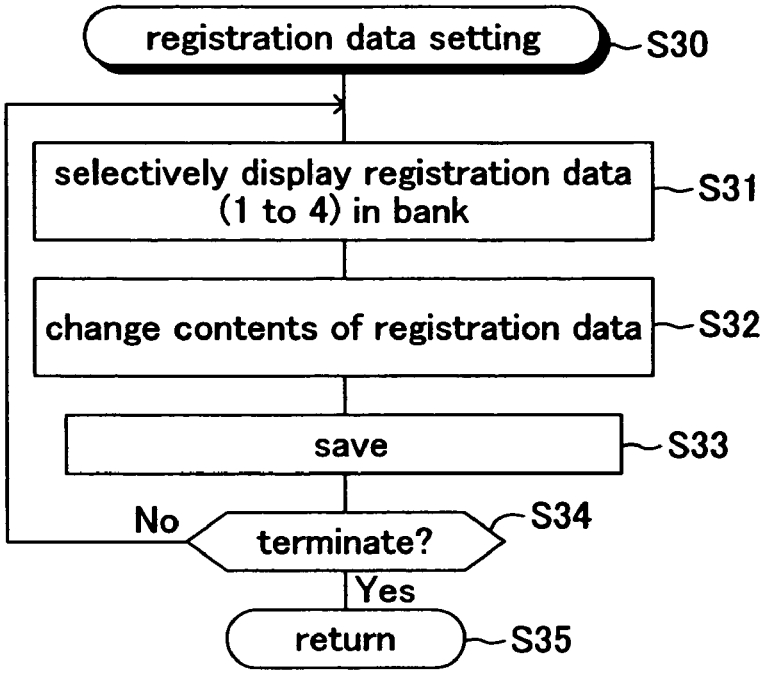
FIG. 7 is a flowchart showing a registration data setting routine executed at the panel operation process in the main program.
Figure 8:
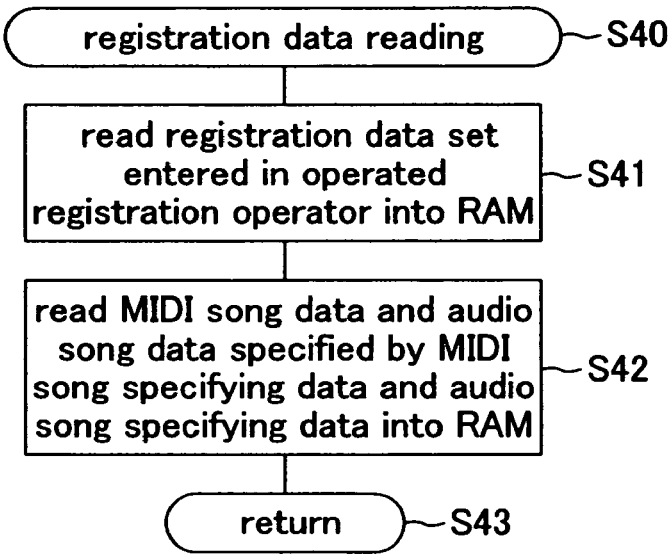
FIG. 8 is a flowchart showing a registration data reading routine executed at the panel operation process in the main program.
Figure 15:
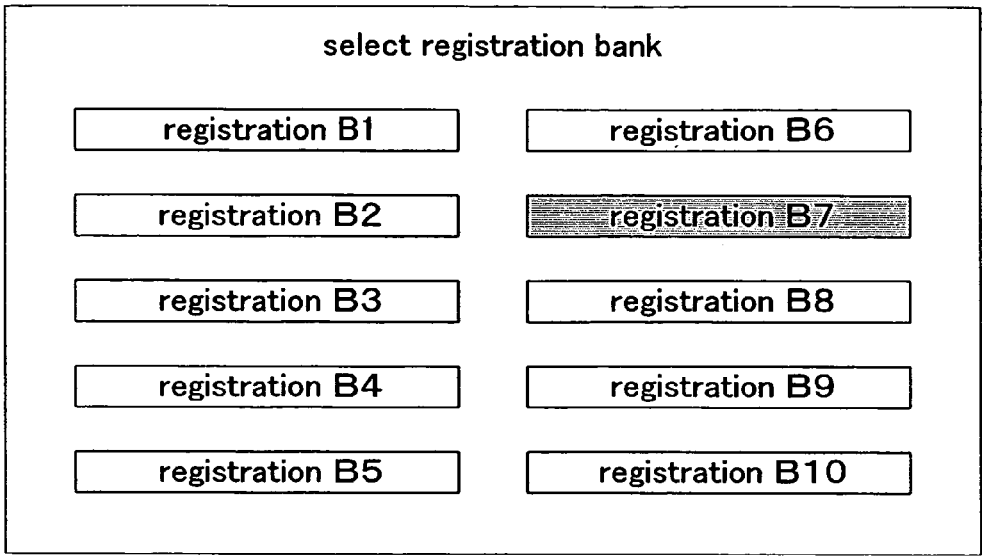
FIG. 15 is a screen for selecting a registration bank displayed on a display unit of the electronic musical instrument.
Figure 16:
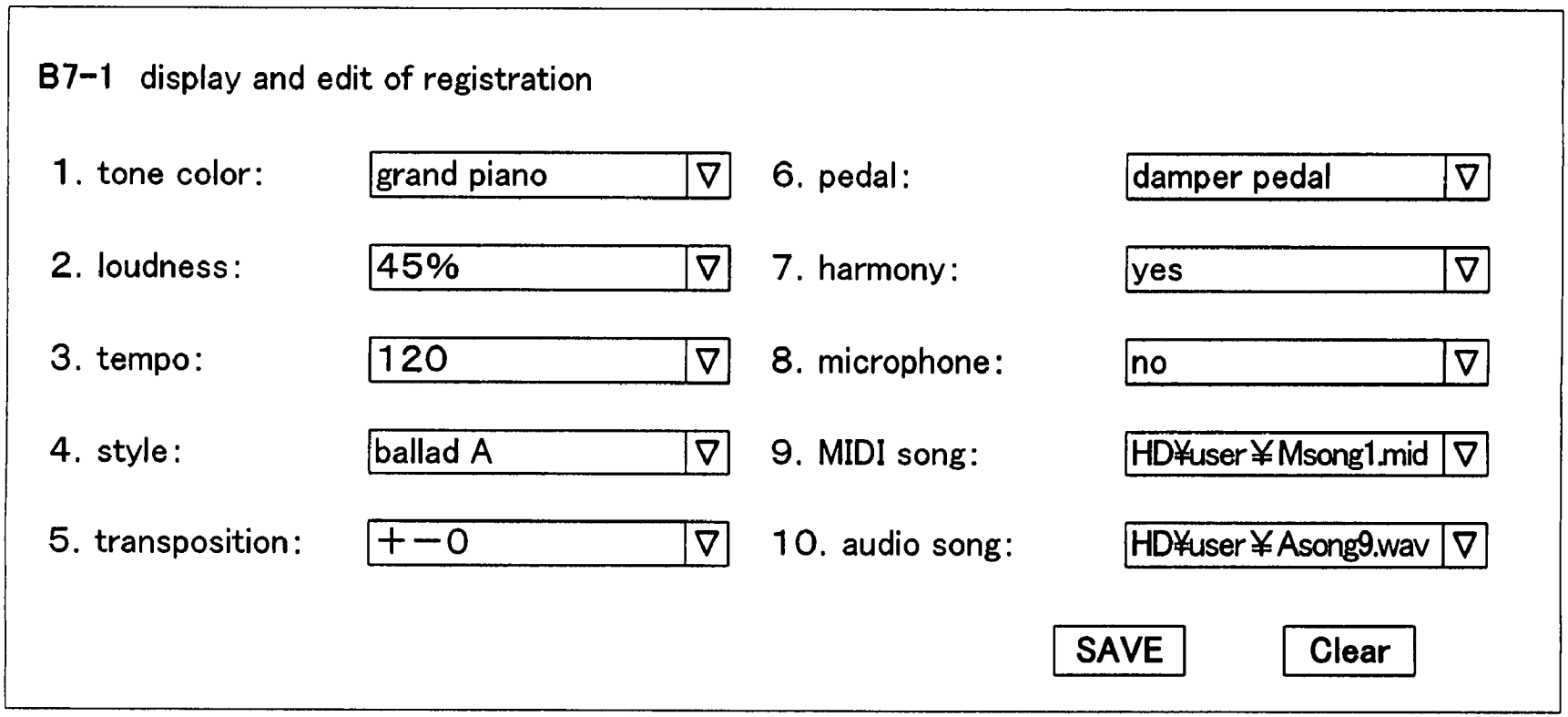
FIG. 16 is a screen for setting registration data displayed on the display unit of the electronic musical instrument.

At this state, if the user operates a display setting operator 12*b*, the CPU 21 executes, at step S24, a registration data setting routine shown in FIG. 7 to allow modification to any one of the registration data sets (four sets in the present embodiment) in the selected registration bank. The modification to registration data can be done only to the registration banks B4 through B10 provided in the external storage device 25. The registration data setting routine is started at step S30. At step S31, the CPU 21 selectively displays the contents (contents of control parameters) of the four registration data sets in the registration bank. When the display setting operator 12*b* is firstly operated at the display state shown in FIG. 15, more specifically, the contents of the first registration data set in the selected registration bank are displayed on the display unit 13. Shown in FIG. 16 is a display state in which the contents of the registration data B7-1 in the registration bank B7 are displayed on the display unit 13. After the first operation of the display setting operator 12*b*, each time the display setting operator 12*b* is operated, the contents of the second, third and fourth registration data set in the selected registration bank are successively displayed.

At the display state of FIG. 16, if the user operates the setting operators 12 to modify the contents of the registration data, the CPU 21 modifies the contents of the registration data by the process of step S32. More specifically, if the user clicks with a mouse any one of triangles each corresponding to a control parameter item shown in FIG. 16, possible options for the clicked control parameter are displayed on the display unit 13. If the user then clicks any one of the displayed options with the mouse, the content of the control parameter is changed to the selected option. If the user then operates the setting operators 12 to update the registration data such as clicking a mark "SAVE" in FIG. 16 with the mouse, the CPU 21 updates, by the process of step S33, the selected registration data in the external storage device 25 to the state displayed on the display unit 13 (i.e., the contents of the registration data shown in FIG. 16). After the modification to the registration data in the external storage device 25, if the user operates the setting operators 12 to terminate the setting of the registration data, the CPU 21 gives "Yes" at step S34 and terminates the registration data setting routine at step S35.

The bank setting processing routine shown in FIG. 6 will now be described again. At the display state of FIG. 15, i.e., at the display state in which a registration bank has been selected, if the user operates the setting operators 12 to enter registration data sets into four registration operators 12*c* to 12*f* (see FIG. 14) contained in the setting operators 12, four registration data sets in the selected registration bank are entered in the registration operators 12*c* to 12*f*, respectively. The data representative of the entry of the registration data into the registration operators 12*c* to 12*f* is stored in the RAM 24. In the display state of FIG. 15, more specifically, by a double-click with a mouse on any one of the displayed registration banks B1 to B10, for example, the entry of the registration data sets into the registration operators 12*c* to 12*f* is instructed. If the user then operates the setting operators 12 to terminate the registration bank setting processing, the CPU 21 gives "Yes" at step S26 and terminates the bank setting processing routine at step S27.

Next explained will be a case in which the user uses registration data for the user's performance on the keyboard 11. In this case, if the user operates any one of the registration operators 12*c* to 12*f* shown in FIG. 14, the CPU 21 executes, at the panel operation processing of step S12 in FIG. 5, a registration data reading routine shown in FIG. 8. The registration data reading routine is started at step S40. At step S41, the CPU 21 reads the registration data set entered in the operated registration operator 12*c* to 12*f* from the ROM 23 or the external storage device 25 and writes into the RAM 24. As shown in FIG. 4, in other words, in addition to the control parameters for controlling the mode for generating musical tones such as tone color, loudness, tempo, style and the like, MIDI song specifying data and audio song specifying data is also written into the RAM 24. At step S42, the CPU 21 then reads MIDI song data (automatic performance data) and audio song data (voice data) that is respectively specified by the MIDI song specifying data and audio song specifying data written into the RAM 24 from the ROM 23 or the external storage device 25. CPU21 writes the read MIDI song data and audio song data into RAM24. The CPU 21 then terminates the registration data reading routine at step S43.

At step S42, the entire audio song data (voice data) may be written into the RAM 24. Alternatively, only the top of the audio song data may be written into the RAM 24. In some cases, more specifically, the amount of audio song data (voice data) is massive, resulting in insufficient storage area for the audio song data in the RAM 24 or prolonged time required until reproduction of the audio song data. In such cases, therefore, when a registration data set is specified by operating the registration operator 12*c* to 12*f* or when a registration data set is specified in the other way that will be described later, only the top of audio song data specified by audio song specifying data may be written into the RAM 24.

Figure 9:
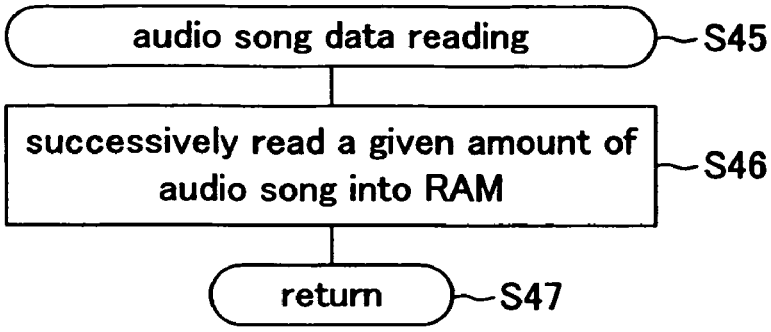
FIG. 9 is a flowchart showing an audio song data reading routine executed at the panel operation process in the main program.
Figure 10:
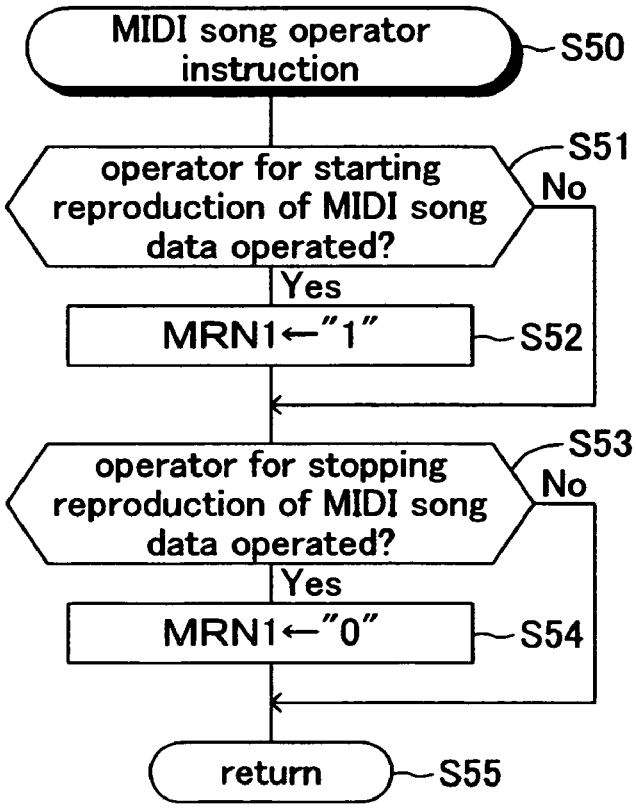
FIG. 10 is a flowchart showing a MIDI song operator instructing routine executed at the panel operation process in the main program.

As for the remaining audio song data, the audio song data reading routine shown in FIG. 9 is executed to read the remaining audio song data at every given timing, at every time a given amount of voice data written into the RAM 24 has been reproduced by a later-described process with remaining audio data in the RAM 24 that has not been reproduced falling below a given amount, at idle times during other program processing, or the like. The audio song data reading routine is started at step S45. At step S46, the CPU 21 successively reads from the ROM 23 or the external storage device 25 a given amount of audio song data (voice data) specified by audio song specifying data and writes into the RAM 24. The CPU 21 then terminates the audio song data reading routine at step S47.

Next explained will be the reproduction of MIDI song data (automatic performance data) and audio song data (voice data). If the user operates the setting operators 12 (e.g., an operator 12*g* for starting reproduction of a MIDI song or an operator 12*h* for stopping reproduction of a MIDI song shown in FIG. 14) to start reproduction of MIDI song data or to stop reproduction of MIDI song data, the CPU 21 executes, at the panel operation processing of step S12 in FIG. 5, a MIDI song operator instructing routine shown in FIG. 10. The MIDI song operator instructing routine is started at step S50. When the user instructs to start reproduction of MIDI song data, the CPU 21 sets, by processes of steps S51, S52, a new MIDI running flag MRN1 to "1" indicative of the state where MIDI song data is reproduced. When the user instructs to stop reproduction of MIDI song data, the CPU 21 sets, by processes of steps S53, S54, the new MIDI running flag MRN1 to "0" indicative of the state where MIDI song data is not reproduced.

Figure 5:
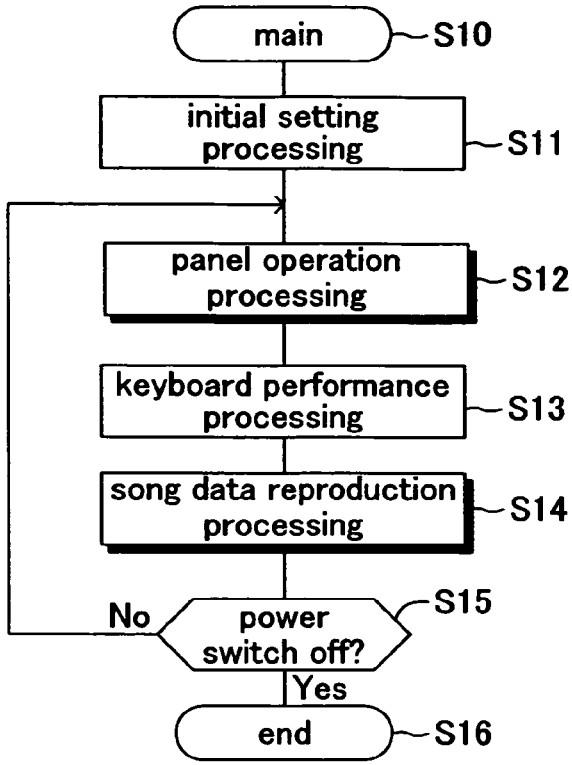
FIG. 5 is a flowchart showing a main program executed on the electronic musical instrument.
Figure 6:
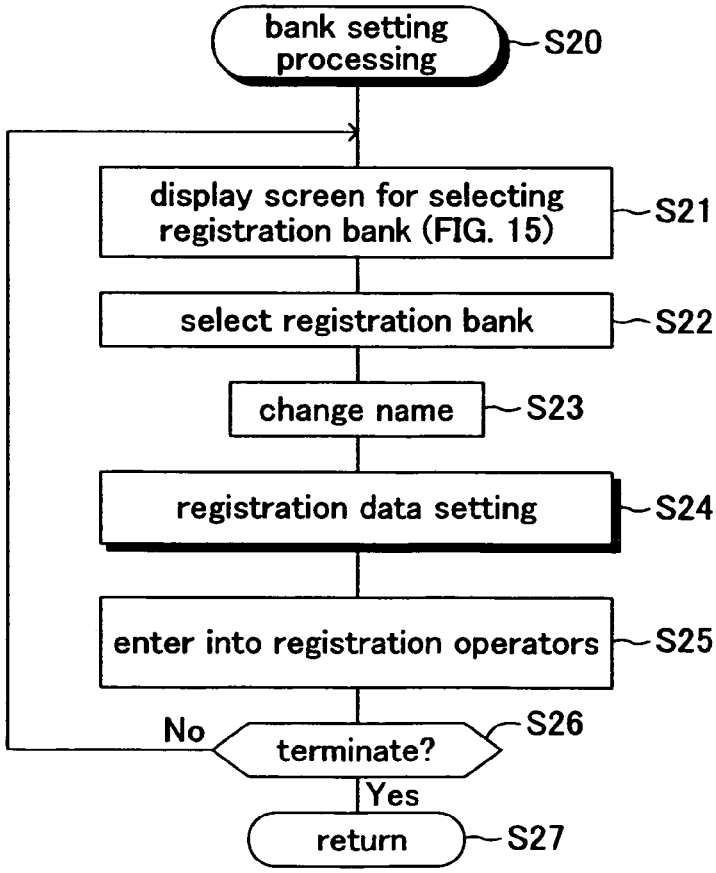
FIG. 6 is a flowchart showing a bank setting process routine executed at a panel operation process in the main program.
Figure 11:
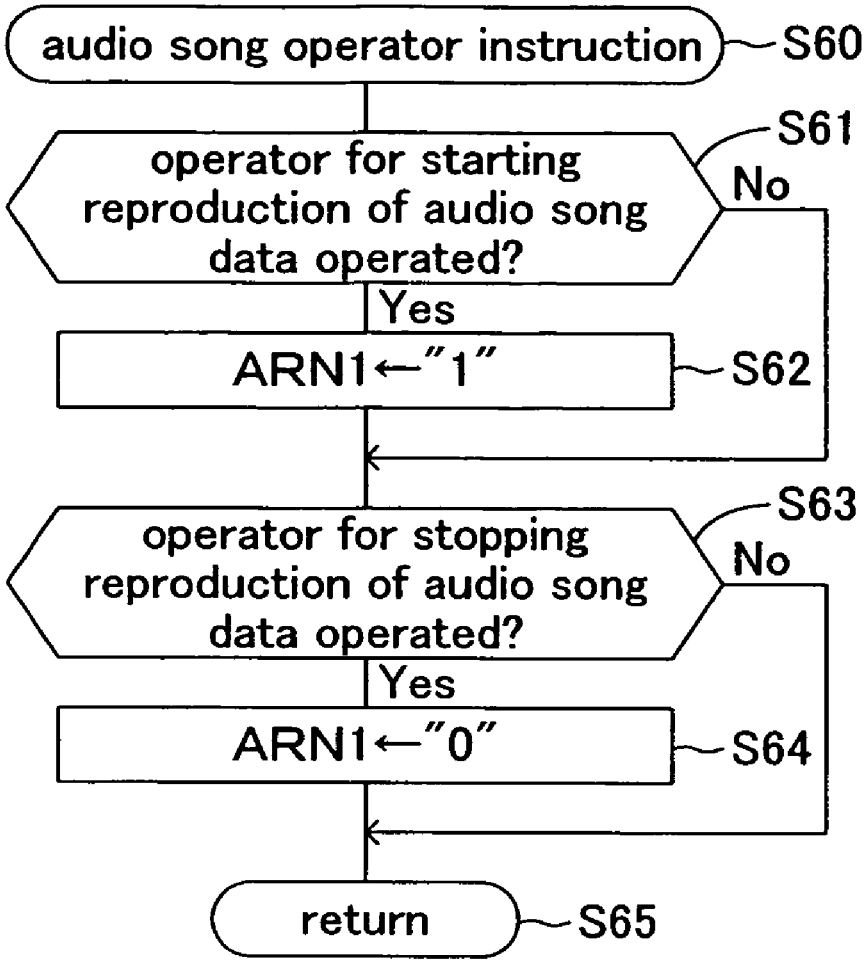
FIG. 11 is a flowchart showing an audio song operator instructing routine executed at the panel operation process in the main program.
Figure 14:
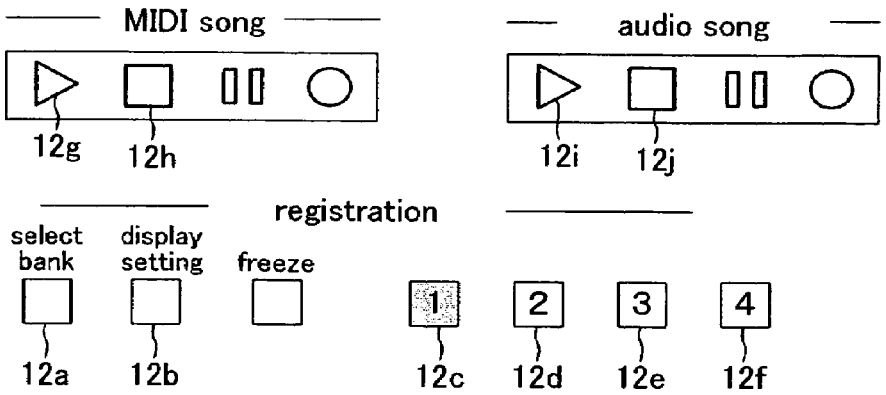
FIG. 14 is a magnified view of part of an operating panel of the electronic musical instrument.

If the user operates the setting operators 12 (e.g., an operator 12*i* for starting reproduction of an audio song or an operator 12*j* for stopping reproduction of an audio song shown in FIG. 14) to start reproduction of audio song data or to stop reproduction of audio song data, the CPU 21 executes, at the panel operation processing of step S12 in FIG. 5, an audio song operator instructing routine shown in FIG. 11. The audio song operator instructing routine is started at step S60. When the user instructs to start reproduction of audio song data, the CPU 21 sets, by processes of steps S61, S62, a new audio running flag ARN1 to "1" indicative of the state where audio song data is reproduced. When the user instructs to stop reproduction of audio song data, the CPU 21 sets, by processes of steps S63, S64, the new audio running flag ARN1 to "0" indicative of the state where audio song data is not reproduced.

Figure 12:
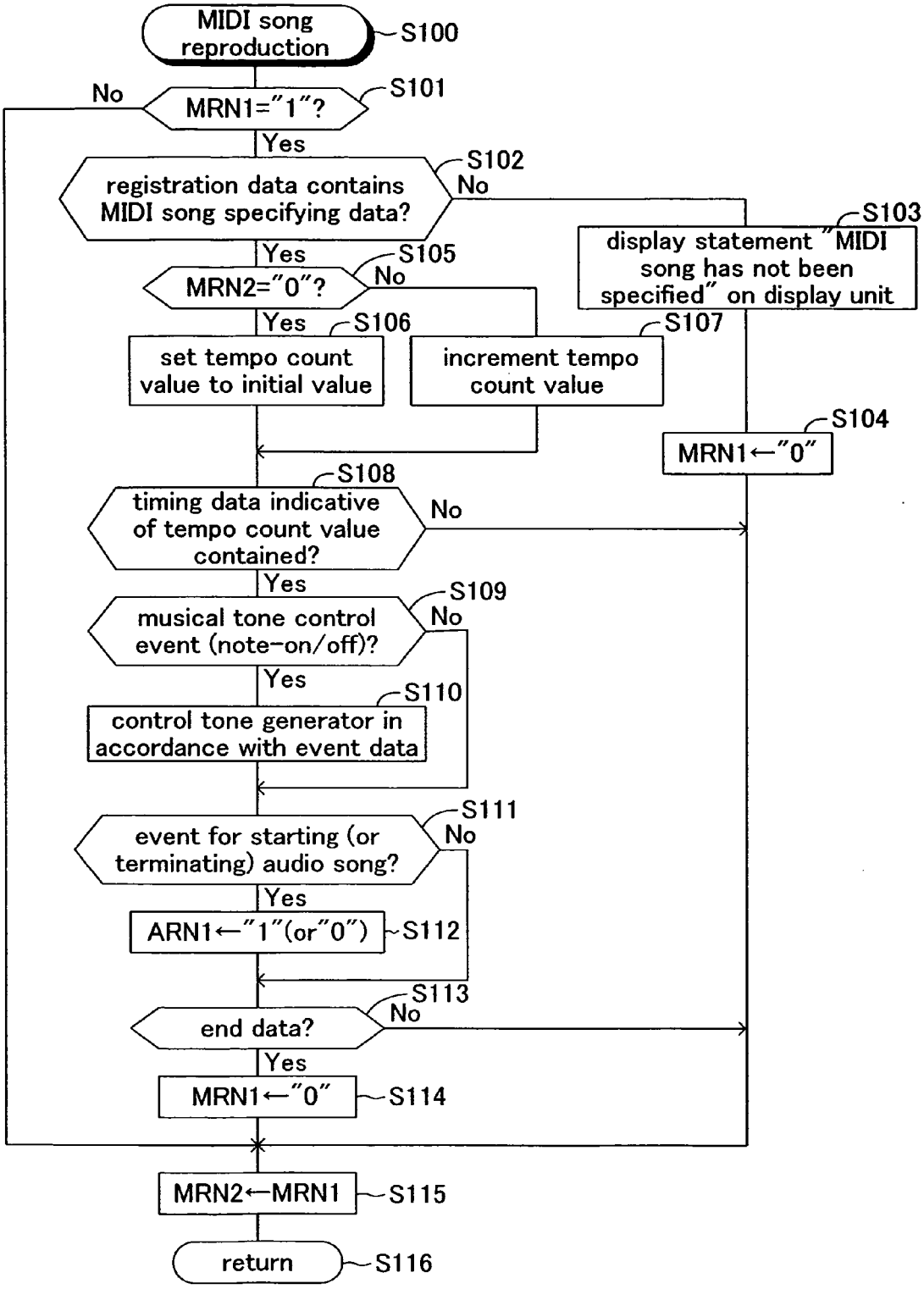
FIG. 12 is a flowchart showing a MIDI song reproduction routine executed at a song data reproduction process in the main program.
Figure 13:
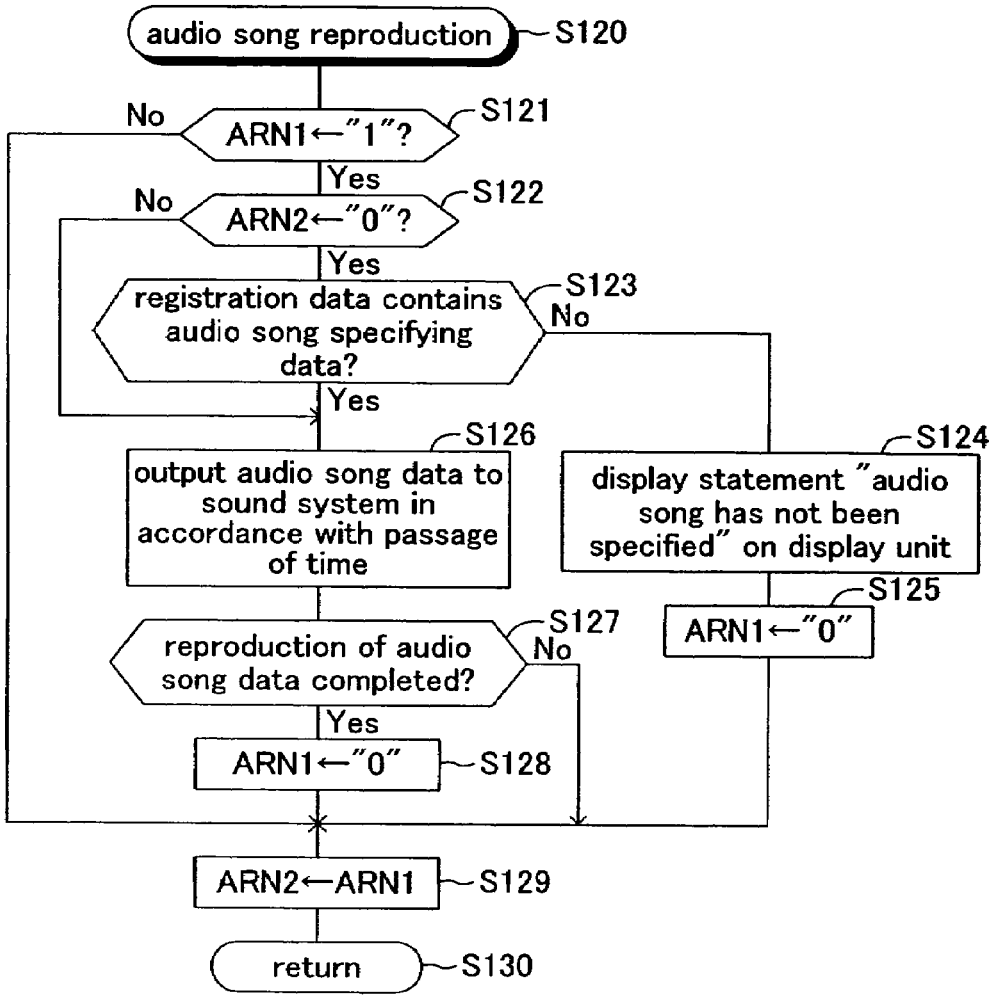
FIG. 13 is a flowchart showing an audio song reproduction routine executed at the song data reproduction process in the main program.

At the song data reproduction processing of step S14 in FIG. 5, a MIDI song reproduction routine shown in FIG. 12 and an audio song reproduction routine shown in FIG. 13 are repeatedly executed at given short time intervals. The MIDI song reproduction routine is started at step S100. At step S101, the CPU 21 determines whether the reproduction of MIDI song data has been currently instructed by determining whether the new MIDI running flag MRN1 is at "1". If the new MIDI running flag MRN1 is at "0" to indicate that the reproduction of MIDI song data is not currently instructed, the CPU 21 gives "No" at step S101 and sets, at step S115, an old MIDI running flag MRN2 to "0" indicated by the new MIDI running flag MRN1. The CPU 21 then temporarily terminates the MIDI song reproduction routine at step S116.

If the new MIDI running flag MRN1 is at "1" to indicate that the reproduction of MIDI song data has been currently instructed, the CPU 21 gives "Yes" at step S101 and determines at step S102 whether registration data in the RAM 24 contains MIDI song specifying data. If MIDI song specifying data is not contained, the CPU 21 gives "No" at step S102, and at step S103 displays on the display unit 13 a statement saying "MIDI song has not been specified". At step S104 the CPU 21 also changes the new MIDI running flag MRN1 to "0". The CPU 21 then executes the above-described process of step S115, and temporarily terminates the MIDI song reproduction routine at step S116. In this case, since "No" will be given at step Sl01 for the later processing, the processes of steps S102 to S114 will not be carried out.

Next explained will be a case in which registration data in the RAM 24 contains MIDI song specifying data. In this case, after the determination of "Yes" at step S102, the CPU 21 determines at step S105 whether it is just the time to start reproducing MIDI song data by determining whether the old MIDI running flag MRN2 indicative of the previous instruction for reproduction of MIDI song data is at "0". If it is determined that it is just the time to start reproducing MIDI song data, the CPU 21 gives "Yes" at step S105. At step S106, the CPU 21 then sets a tempo count value indicative of the progression of a song to the initial value. If it is determined that it is not the time to start reproducing MIDI song data, but the reproduction has been already started, on the other hand, the CPU 21 gives "No" at step S105 and increments, at step S107, the tempo count value indicative of the progression of a song.

After the process of step S106 or step S107, the CPU 21 determines at step S108 whether MIDI song data contains timing data indicative of tempo count value. If timing data indicative of tempo count value is not contained, the CPU 21 gives "No" at step S108 and executes the above-described process of step S115. The CPU 21 then temporarily terminates the MIDI song reproduction routine at step S116. If timing data indicative of tempo count value is contained, the CPU 21 gives "Yes" at step S108 and determines at step S109 whether event data corresponding to the contained timing data is musical tone control event data, i.e., note-on event data, note-off event data or other musical tone control event data for controlling tone color or loudness.

If the event data is not musical tone control event data, the CPU 21 proceeds to step S111. If the event data is musical tone control event data, the CPU 21 outputs, at step S10, the musical tone control event data to the tone generator 14 to control the mode in which a musical tone signal is generated. More specifically, If the event data is note-on event data, the CPU 21 supplies note number data and velocity data to the tone generator 14 and instructs to start generating a digital musical tone signal corresponding to the note number data and the velocity data. If the event data is note-off event data, the CPU 21 instructs the tone generator 14 to terminate the generation of a digital musical tone signal corresponding to currently generated note number data. Due to these processes, similarly to the above-described performance on the keyboard 11, the tone generator 14 starts generating a digital musical tone signal in response to note-on event data, or terminates the generation of a digital musical tone signal in response to note-off event data. In a case where the event data is musical tone control event data for controlling tone color and loudness, control parameters composing the event data are supplied to the tone generator 14, so that the tone color, loudness and the like of a digital musical tone signal to be generated by the tone generator 14 are controlled on the basis of the supplied control parameters. Due to these processes, music that is automatically performed on the basis of MIDI song data (automatic performance data) specified by MIDI song specifying data is played.

At step S111, the CPU 21 then determines whether the event data corresponding to the timing data is an event for starting an audio song or an event for terminating an audio song. If the event data is not for starting or terminating an audio song, the CPU 21 proceeds to step S113. If the event data is an event for starting an audio song, the CPU 21 sets, at step S112, the new audio running flag ARN1 to "1". If the event data is an event for terminating an audio song, the CPU 21 sets, at step S112, the new audio running flag ARN1 to "0". Due to these processes, a change to the new audio running flag ARN1 is made by the reproduction of MIDI song data.

At step S113, the CPU 21 determines whether the reading of MIDI song data has reached end data. If not, the CPU 21 gives "No" at step S113 and executes the above-described process of step S115. The CPU 21 then temporarily terminates the MIDI song reproduction routine at step S116. Due to these processes, the processing composed of steps S102, S105, and S107 through S113 is repeatedly executed until the reading of MIDI song data is completed, controlling the generation of musical tones and updating the new MIDI running flag MRN1.

If the reading of MIDI song data has reached end data, the CPU 21 gives "Yes" at step S113, and sets the new MIDI running flag MRN1 to "0" at step S114. The CPU 21 then executes the above-described process of step S115, and temporarily terminates the MIDI song reproduction routine at step S116. In this case, therefore, even if the MIDI song reproduction routine is carried out, the reproduction of MIDI song data is terminated without executing the processes of steps S102 through S114. In addition to the above case, the reproduction of MIDI song data is also terminated in a case where the new MIDI running flag MRN1 is set to "0" during reproduction of MIDI song data by the process of step S54 of the MIDI song operator instructing routine shown in FIG. 10.

The audio song reproduction routine is started at step S120 shown in FIG. 13. At step S121, the CPU 21 determines whether the reproduction of audio song data has been currently instructed by determining whether the new audio running flag ARN1 is at "1". If the new audio running flag ARN1 is at "0" to indicate that the reproduction of audio song data is not currently instructed, the CPU 21 gives "No" at step S121 and sets, at step S129, an old audio running flag ARN2 to "0" indicated by the new audio running flag ARN1. The CPU 21 then temporarily terminates the audio song reproduction routine at step S130.

If the new audio running flag ARN1 is at "1" to indicate that the reproduction of audio song data is currently instructed, the CPU 21 gives "Yes" at step S121. The CPU 21 then determines at step S122 whether it is just the time to start reproducing audio song data by determining whether the old audio running flag ARN2 indicative of the previous instruction for reproduction of audio song data is at "0". If it is determined that it is just the time to start reproducing audio song data, the CPU 21 gives "Yes" at step S122. The CPU 21 then determines at step S123 whether registration data in the RAM 24 contains audio song specifying data. If audio song specifying data is not contained, the CPU 21 gives "No" at step S123, and at step S124 displays on the display unit 13 a statement saying "audio song has not been specified". At step S125 the CPU 21 sets the new audio running flag ARN1 to "0". The CPU 21 then executes the above-described process of step S129, and temporarily terminates the audio song reproduction routine at step S130. In this case, since "No" will be given at step S121 for the later processing, the processes of steps S122 to S128 will not be carried out.

Next explained will be a case in which registration data in the RAM 24 contains audio song specifying data. In this case, after the determination of "Yes" at step S123, the CPU 21 successively supplies, at step S126, audio song data (digital voice data) stored in the RAM 24 to the sound system 19 in accordance with passage of time. The sound system 19 converts the supplied digital voice data to analog voice signals, and supplies the signals to the speakers 19*a*. Due to these processes, the speakers 19*a* emits voices corresponding to the audio song data. Once the reproduction of audio song data is started, the old audio running flag ARN2 is set to "1" by the process of step S129. After the process of step S122, as a result, the process of step S126 is executed without the process of step S123.

After the process of step S126, the CPU 21 determines at step S127 whether the reproduction of audio song data has been completed. If the reproduction of audio song data has not been completed, the CPU 21 gives "No" at step S127 and executes the process of step S129. The CPU 21 then temporarily terminates the audio song reproduction routine at step S130. Due to these processes, the processing composed of steps S121, S122, S126, S127 and S129 is repeatedly executed until the reproduction of audio song data is completed, controlling the reproduction of audio song data and updating the old audio running flag ARN2.

If the reproduction of audio song data has been completed, the CPU 21 gives "Yes" at step S127, and sets the new audio running flag ARN1 to "0" at step S128. The CPU 21 then executes the above-described process of step S129, and temporarily terminates the audio song reproduction routine at step S130. In this case, therefore, even if the audio song reproduction routine is carried out, the reproduction of audio song data is terminated without executing the processes of steps S122 through S128. In addition to the above case, the reproduction of audio song data is also terminated in a case where the new audio running flag ARN1 is set to "0" during reproduction of audio song data by the process of step S64 of the audio song operator instructing routine shown in FIG. 11 or the process of step S112 of the MIDI song reproduction routine shown in FIG. 12.

In the above-described embodiment, as apparent from the above descriptions, each registration data set contains a plurality of control parameters, MIDI song specifying data (automatic performance specifying data) and audio song specifying data (voice specifying data), enabling a user to specify the mode in which musical tones are generated, MIDI song data and audio song data at once only by selecting a registration data set. As a result, the above embodiment enables the user to play a melody part while generating accompaniment tones on the basis of previously recorded voice data or to add an audio song or audio phrase as background music (BGM) or effect tones during a performance by the user or during reproduction of automatic performance tones on the basis of automatic performance data, providing the user with enriched music.

In the above embodiment, in addition, audio song start event data is embedded in MIDI song data. As a result, the above embodiment realizes automatic reproduction of background music (BGM) and effect tones such as audio song and audio phrase at user's desired timing during an automatic performance on the basis of the MIDI song data.

In carrying out the present invention, furthermore, it will be understood that the present invention is not limited to the above-described embodiment, but various modifications may be made without departing from the spirit and scope of the invention.

Figure 17:
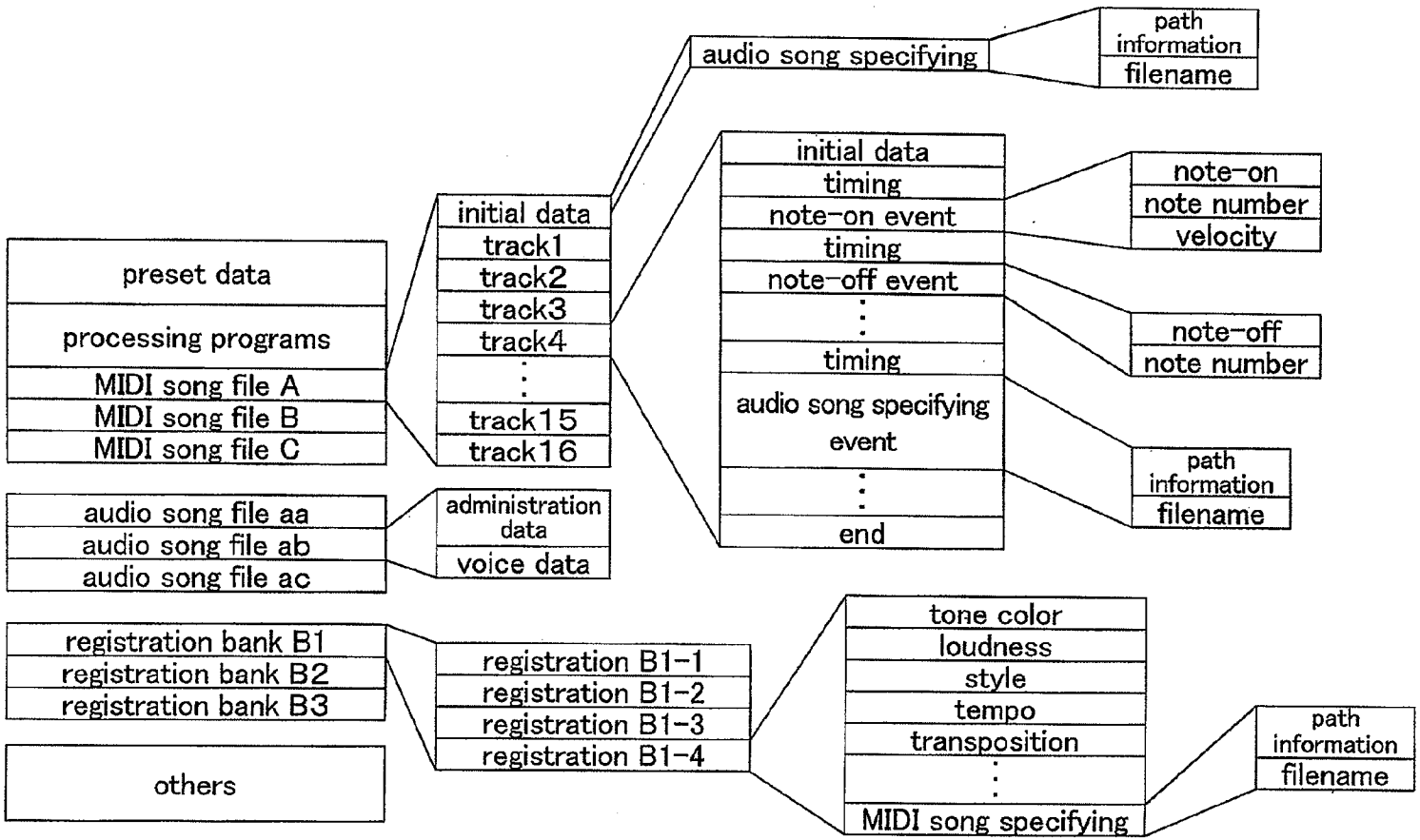
FIG. 17 is a memory map showing data stored in a ROM of an electronic musical instrument according to a modified example.

In the above embodiment, for example, a registration data set contains both MIDI song specifying data and audio song specifying data. As shown in FIG. 17, however, the above embodiment may be modified such that a registration data set contains MIDI song specifying data only, with audio song specifying data being embedded in MIDI song data (automatic performance data). In this case, audio song specifying data may be embedded in initial data contained in MIDI song data. Alternatively, track data may embed audio song specifying data along with timing data as event data instead of or in addition to audio song start (or completion) event data.

In either case, when MIDI song data is written into the RAM 24 at the time of specifying registration data, the MIDI song data in the RAM 24 is searched for audio song specifying data. If audio song specifying data is found, part of or entire audio song data that is specified by the audio song specifying data is read into the RAM 24. Alternatively, the audio song specifying data may be read into the RAM 24 at the time of starting reproduction of MIDI song data or in synchronization with the reproduction of MIDI song data.

The above modified example also enables the user to specify the mode in which musical tones are generated, automatic performance data and voice data at once only by selecting a registration data set, providing the user with enriched music as in the case of the above-described embodiment. In addition, since audio song specifying data is contained in MIDI song data, the modified example enables the user to establish his/her desired audio song specifying data to realize effective reproduction of the both data and facilitated synchronous reproduction. Since audio song specifying data is stored in MIDI song data along with timing data representative of timing at which a musical tone signal is generated in a song, furthermore, the modified example realizes automatic reproduction of background music (BGM) and effect tones such as audio song and audio phrase at user's desired timing during an automatic performance on the basis of the MIDI song data.

In the above modified example, audio song specifying data is embedded in MIDI song data. Conversely, however, MIDI song specifying data may be embedded in audio song data. In this case, the MIDI song specifying data is contained in administration data corresponding to the audio song data (WAV data). Furthermore, the MIDI song specifying data may store timing data representative of the timing at which MIDI song data is reproduced.

In the above-described embodiment, furthermore, MIDI song data contains note-on event data, note-off event data, musical tone control parameters and audio song start (completion) event data. In addition to those, however, registration specifying data may be embedded in MIDI song data along with timing data in order to switch registration data sets during reproduction of automatic performance data.

In the above-described embodiment, furthermore, timing data representing the timing of an event in absolute time is applied for MIDI song data. Instead of absolute timing data, however, relative timing data representative of relative time from the previous event timing to the current event timing may be employed.

In the above-described embodiment, furthermore, a registration data set is specified by use of the registration operators 12*c* to 12*f*. In addition to the registration operators, however, sequence data for successively switching registration data sets may be stored in the RAM 24 so that the sequence data is read out with the passage of time to successively switch the registration data sets. Furthermore, the setting operators 12 may include a registration switching operator to enable the user to successively switch, at each operation of the operator, the registration data sets on the basis of the sequence data.

In the above-described embodiment, furthermore, the present invention is applied to the electronic musical instrument having the keyboard 11 as a performance operating portion. In replacement for the keys, however, the present invention may be applied to an electronic musical instrument having mere push switches, touch switches or the like as performance operators for defining pitch. Particularly, the present invention can be applied to other electronic musical instruments such as electronic stringed instruments and electronic wind instruments.

What is claimed is:

1. An electronic musical instrument comprising:

an automatic performance data storage portion for storing a plurality of automatic performance data strings each composed of a performance data string for controlling generation of a string of musical tone signals that form a song;

a voice data storage portion for storing a plurality of voice data strings each composed of a data string representative of a voice signal;

a plurality of performance operators playable by a user for causing the generation of musical tone signals;

a plurality of setting operators, provided on an operating panel, for setting a plurality of control parameters that define a mode of musical tone signals generated by the user playing said performance operators;

a registration data storage for storing a plurality of registration data sets that are each composed of the plurality of control parameters, automatic performance specifying data for specifing one of the plurality of automatic performance data strings, and voice specifying data for specifying one of the plurality of voice data strings;

a plurality of registration operators for selecting the plurality of registration data sets; and a selection section for, when any one of the plurality of registration operators is operated, simultaneously selecting a plurality of control parameters, an automatic performance data string, and a voice data string, wherein the plurality of control parameters are included in a registration data set selected by an operated registration operator, wherein the automatic performance data string is specified by automatic performance specifying data that is included in the registration data set selected by the operated registration operator, and wherein the voice data string is specified by voice specifying data included in the registration data set selected by the operated registration operator.

2. An electronic musical instrument according to claim 1, wherein the selection portion includes a registration control portion for loading into a temporary storage portion, when one of the registration data sets is selected, the selected plurality of control parameters, the selected automatic performance data string, and the selected voice data string, wherein the electronic musical instrument controls mode of the musical tone signals generated by user playing of the performance operators on the basis of the control parameters loaded into the temporary storage, generates automatic performance musical tone signals on the basis of the automatic performance data string loaded into the temporary storage, and generates a voice signal on the basis of the voice data string loaded into the temporary storage portion.

3. An electronic musical instrument according to claim 2 wherein the registration control portion loads into the temporary storage portion, at the time of selecting a registration data set from among the registration data sets, only the top of voice data specified by the voice specifying data.

4. An electronic musical instrument comprising:

an automatic performance data storage portion for storing a plurality of automatic performance data strings each composed of a performance data string for controlling generation of a string of musical tone signals that form a song;

a voice data storage portion for storing a plurality of voice data strings each composed of a voice data string representative of a voice signal;

a plurality of performance operators play able by a user to cause the generation of musical tone signals:

a plurality of setting operators provided on an operating panel for setting a plurality of control parameters that define a mode of musical tone signal generate by user playing of the performance operators;

a registration data storage for storing a plurality of registration data sets that are each composed of the plurality of control parameters and one of two types of specifying data that respectively specify one of the plurality of automatic performance data strings and one of the plurality of the voice data strings, wherein the other one of the two types of specifying data is included in one of the automatic performance data string and the voice data string specified by one of the two types of specifying data;

a plurality of registration operators for selecting the plurality of registration data sets; and a selection portion for, when any one of the plurality of registration operator is operated, simultaneously selecting a plurality of control parameters, an automatic performance data string, and a voice data string, wherein the plurality of control parameters are included in a registration data set selected by an operated registration operator, wherein one of the automatic performance data string and the voice data string is specified by one of the two types of specifying data included in the registration data set selected by the operated registration operator, and wherein the other one of the automatic performance data string and the voice data string is specified by the other one of the two types of specifying data included in the automatic performance data string or voice data string specified by the one of the two types of specifying data.

5. An electronic musical instrument according to claim 4, wherein the selection portion includes a registration control portion for loading into temporary storage portion, when one of the registration data sets is selected, the selected plurality of control parameters, the selected automatic performance data string, and the selected voice data string, wherein the electronic musical instrument controls mode of the musical tone signals generated by user playing of the performance operators on the basis of the plurality of control parameters loaded into the temporary storage, generates automatic performance musical tone signals on the basis of the automatic performance data string loaded into the temporary storage, and generates a voice signal on the basis of the voice data string loaded into the temporary storage portion.

6. An electronic musical instrument according to claim 5 wherein the registration control portion loads into the temporary storage portion, at the time of selecting a registration data set from among the registration data sets, only the top of voice data specified by the voice specifying data.

7. An electronic musical instrument according to claim 4 wherein the one of the two types of specifying data is automatic performance specifying data while the other specifying data is voice specifying data; the automatic performance data storage portion stores the performance data string along with timing data representative of a timing at which a musical tone signal is generated in a song; and the voice specifying data is embedded in the performance data string along with the timing data.

8. An electronic musical instrument according to claim 4 wherein the registration control portion loads into the temporary storage portion, at the time of selecting a registration data set from among the registration data sets, only the top of voice data specified by the voice specifying data.

* * * * *